United States Patent [19]

Scholz

[11] Patent Number: 4,926,599

[45] Date of Patent: May 22, 1990

[54] ADJUSTABLE LOUVERED AWNING

[76] Inventor: Edward Scholz, 5131 W. Ainslie, Chicago, Ill.

[21] Appl. No.: 297,578

[22] Filed: Jan. 17, 1989

[51] Int. Cl.[5] ..... E06B 7/086

[52] U.S. Cl. ..... 49/88; 49/90

[58] Field of Search ..... 49/87, 88, 90, 74, 75; 98/121.1, 110

[56] References Cited

U.S. PATENT DOCUMENTS

| | | | |
|---|---|---|---|
| 205,064 | 6/1978 | Doolittle | 49/90 |
| 298,860 | 5/1884 | Keeran | 49/90 X |
| 2,405,899 | 8/1946 | Otti | 49/87 |
| 3,001,250 | 9/1961 | Kenny | 49/87 |
| 3,500,739 | 3/1970 | Dry | 98/121.2 X |
| 3,954,023 | 5/1976 | Perez-Aguilar | 49/87 X |

FOREIGN PATENT DOCUMENTS

| | | | |
|---|---|---|---|
| 747864 | 4/1956 | United Kingdom | 49/90 |

*Primary Examiner*—Philip C. Kannan

*Attorney, Agent, or Firm*—Willian Brinks Olds Hofer Gilson & Lione

[57] ABSTRACT

An adjustable, louvered awning incorporating a combination angle adjustment and locking mechanism. The mechanism enables the awning's movable vanes to be securely locked in a plurality of positions selected by the operator.

4 Claims, 3 Drawing Sheets

ADJUSTABLE LOUVERED AWNING

FIELD OF THE INVENTION

This invention relates generally to awnings and, more particularly, to awnings having a plurality of shutters or louver vanes which may be opened or closed. It relates particularly to the construction and operation of such awnings.

BACKGROUND OF THE INVENTION

Heretofore, awnings of this type have been designed and constructed for use on the outside of a window, or over a porch or balcony or the like. Such awnings comprise a frame carrying a plurality of pivoted louver vanes which may be opened or closed to admit light, improve air flow, or exclude rain, etc.

A major problem with known movable awning louvers is their tendency to change position when common environmental forces are applied to them. The magnitude of the forces generated by wind and rain and effective on an awning may be quite large and cause unwanted louver angle changes, excessive noise from the flapping of the louvers, and premature failure of the awning structure due to the dynamic stresses created. Although prior awnings of this type have embodied various means for adjusting the louver vane angle by the use of lever arms, chains, and toggle joints, they have not provided a construction wherein the louvers are locked in their selected position to insure against unwanted louver displacement.

SUMMARY OF THE INVENTION

An object of the present invention is to provide an improved adjustable louvered awning. Another object is to provide a louvered awning incorporating a simple, reliable and easy to use locking mechanism. Still another object is to provide a louvered awning locking mechanism that prevents unwanted movement of the louver vanes from their selected position when common environmental forces, such as wind and rain, are applied. A further object is to provide an improved angle adjustment mechanism for adjustable louvered awnings with means to adjust the vanes at a plurality of distinct angles plainly marked on the adjustment mechanism. Yet a further object is to provide an adjustable louvered awning that better withstands the effects of environmental forces, resulting in improved durability and a longer service life.

DETAILED DESCRIPTION OF THE DRAWINGS

The invention, including its construction and operation, as well as additional objects and advantages thereof, is illustrated more or less diagrammatically in the accompanying drawings, wherein.

DESCRIPTION OF THE PREFERRED EMBODIMENT

Figure 1:
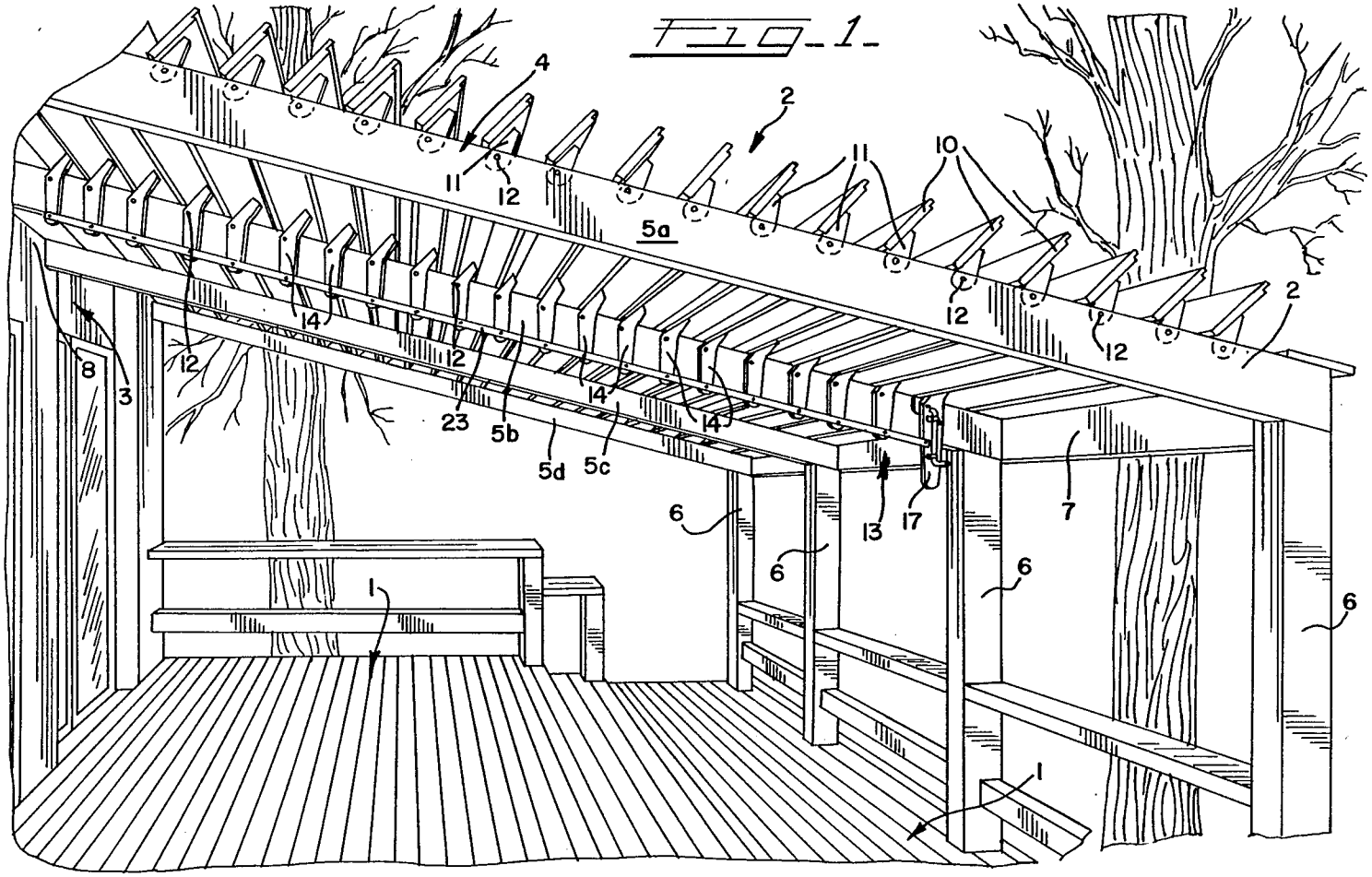
FIG. 1 is a perspective view of a porch or deck surmounted by an adjustable, louvered awning embodying features of the present invention, with the louvers open.

Referring to FIG. 1, a deck or porch 1 on the back of a house is illustrated. Mounted on the deck 1 is an adjustable, louvered awning 2 embodying features of the invention.

The awning 2 extends outwardly from the vertical back wall 3 of a house, for example, to which the deck 1 is attached. The awning includes a frame 4 fastened to the back wall 3 by suitable means. The frame 4 comprises flat, rectangular, cross-sectional beams 5 which are inclined downwardly at a desired awning pitch angle to vertical support columns 6.

The vertical columns 6 extend down to the deck 1, providing load bearing support for the frame 4. In the embodiment illustrated they are also flat, rectangular, cross-sectional beams.

As shown in FIG. 1, the awning frame includes four beams 5 which form a rectangular structure. Four columns 6 support them. The upper ends of the columns 6 and the lower ends of the beams 5 are connected by a cross beam 7. Similarly, a cross beam 8 connects the upper ends of the beams 5 at the house.

Pivotally mounted on top of the frame 4 are a series of louver vanes 10. Each louver vane 10*a* in the illustrated embodiment is connected to each beam 5 for pivoted movement between the open position seen in FIG. 1 and the closed position seen in FIG. 2. One louver vane 10*b* at the bottom of the beams 5 and two louver vanes 10*c* at the top are fixed to the beams 5 rather than pivoted.

The pivoted connections between each vane 10*a* and three of the beams 5, identified as 5*a*, 5*c*, and 5*d*, are identical. They comprise ear-shaped fittings 11 fastened to the lower surface of each vane 10*a* at the upper edge of each vane. These fittings 11 are in alignment with one side of each of the beams 5*a*, 5*c*, and 5*d*. The lower end of each fitting 11 is journaled on a pivot pin 12 protruding from that side of each beam 5*a*, 5*c*, and 5*d*.

The pivotal connection between each vane 10*a* the beam 5*b* is different. It is effected through a vane actuator mechanism 13 which is operated to open and close the vanes, as well as lock them, according to the present invention.

The actuation mechanisms 13 includes a lever arm 14 attached to each of the vanes 10*a* except the lower most vane 10*a*. This lower vane 10*a* has the operating arm 17 of the mechanism 13 attached to it.

The operating arm 17, like each of the aforementioned fittings 11, is journaled on a pivot pin 12 protruding from one side of the beam 5*b*. Similarly, each of the lever arms 14 is journaled on a pivot pin 12.

At the lower end of each vane lever arm 14, and at about the center of the operating arm 17, an operating bar 23 is attached. The operating bar 23 extends parallel to the line of the pivot pins 12 and is pivotally connected to each arm. As now will be recognized, movement of the operating arm 17 is thus effective to correspondingly move the lever arms 14 in the same manner. The operating arm 17 is similar in configuration to the lever arms 14 but is of greater length, in order to provide sufficient leverage for each operation.

Figure 4:
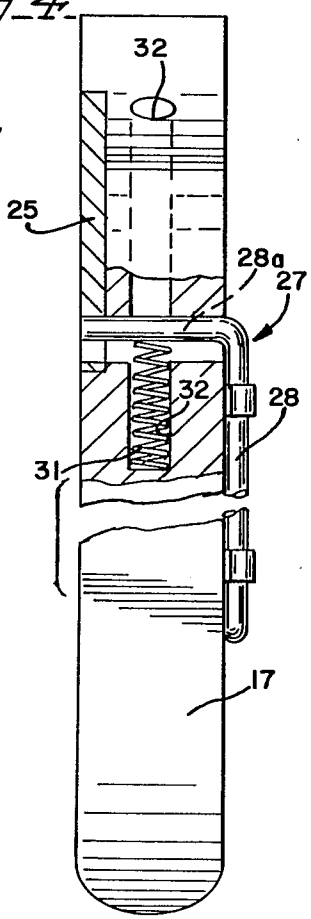
FIG. 4 is a sectional view taken along line 4—4 of FIG. 3, with parts removed.
Figure 3:
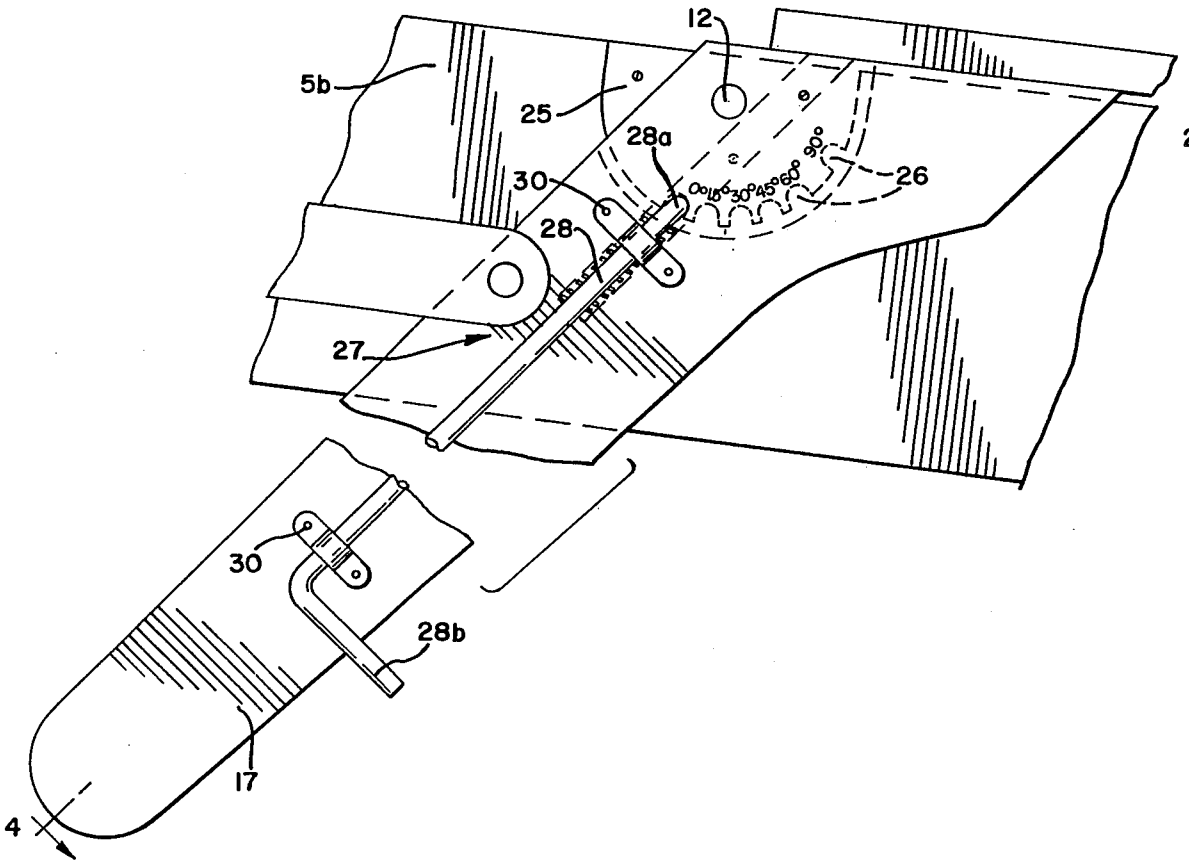
FIG. 3 is an enlarged, side elevational view of the actuator and locking assembly for the louver.

Referring now to FIGS. 3 and 4, mounted between the beam 5*b* and the operating arm 17 is an indexing plate 25 which is semi-circular in shape and constructed from ½" steel plate. Along the circumference of the indexing plate 25 are located index slots 26, which may be positioned at any desired points along the circumference of the indexing plate 25 depending on the louver vane adjustment angles desired.

The indexing plate 25 is fixed to the beam 15*b* and counter-sunk into it. A pivot pin 12 associated with the arm 17 extends outwardly of the center of the plate 25.

The operating arm 17 is mounted on its pivot pin 12 against the outer surface of the indexing plate 25. On the side 26 of the arm 17 opposite the plate 25 an arm locking mechanism 27 is mounted. It includes an actuating rod 28 fabricated from steel with its upper end 28*a* bent at 90° so as to allow the end 28*a* to pass through an aperture 29 in the operating arm 17 and engage one of the index slots 26. The actuating rod 28 is mounted adjacent and parallel to the outer surface of operating arm 17 in bearing supports 30, allowing the actuating rod 28 to slide longitudinally of the operating arm 17.

The aperture 29 through which the rod end 28*a* extends is actually elongated in the direction of the length of the arm 17. As such, the rod end 28*a* is permitted one-half inch of travel in the aperture 29, longitudinally of the arm. This permits the rod end 28*a* to move into and out of engagement with the index slots 26.

The rod end 28*a* is biased toward engagement with the slots 26 by a coil spring 31 seated in a spring hole 32 formed in the arm 17. As illustrated, the coil spring 31 is introduced into the hole 32 before the rod end 28*a* is inserted in the aperture 29. The coil spring 31 normally supplies sufficient force to keep the actuating rod 28 positioned with its end 28*a* in index slots 26 at all angle adjustment positions, and under all foreseeable external forces applied to the louver vane structure. To release the rod end 28*a* from a slot 26, the bent lower end 28*b* of the rod 28 is pulled downwardly by an operator.

To operate the adjustable louvered awning 2, the operator grasps the lower end 28*b* of the rod 28 and releases the lock mechanism by pulling the rod down against rod coil spring 3. The rod 28 then moves out of engagement with an index slot 26.

While continuing to apply a downward force on the rod 28, the operator freely pivots the operating arm 17 about its' pivot pin 12. This causes all the louver vanes 10*a* to move simultaneously from their completely closed position to any selected open position.

When the operator has selected the desired louver vane angle, he may lock the louver vanes 10*a* in place by simply releasing the downward pressure on the rod 28. This will allow rod coil spring 31 to exert an upward force upon actuating rod 28, causing the actuating rod 28 to slide up into engagement with an adjacent index slot 26 located on the circumference of index plate 25.

As mentioned above, the number of index slots 26 and their location along index plate 25 may be varied, depending upon the number and louver angle positions desired. In FIG. 3 index slots 26 are shown so as to provide louver vane angle positions of 15°, 30°, 45°, 60°, 75°, 90°.

Figure 2:
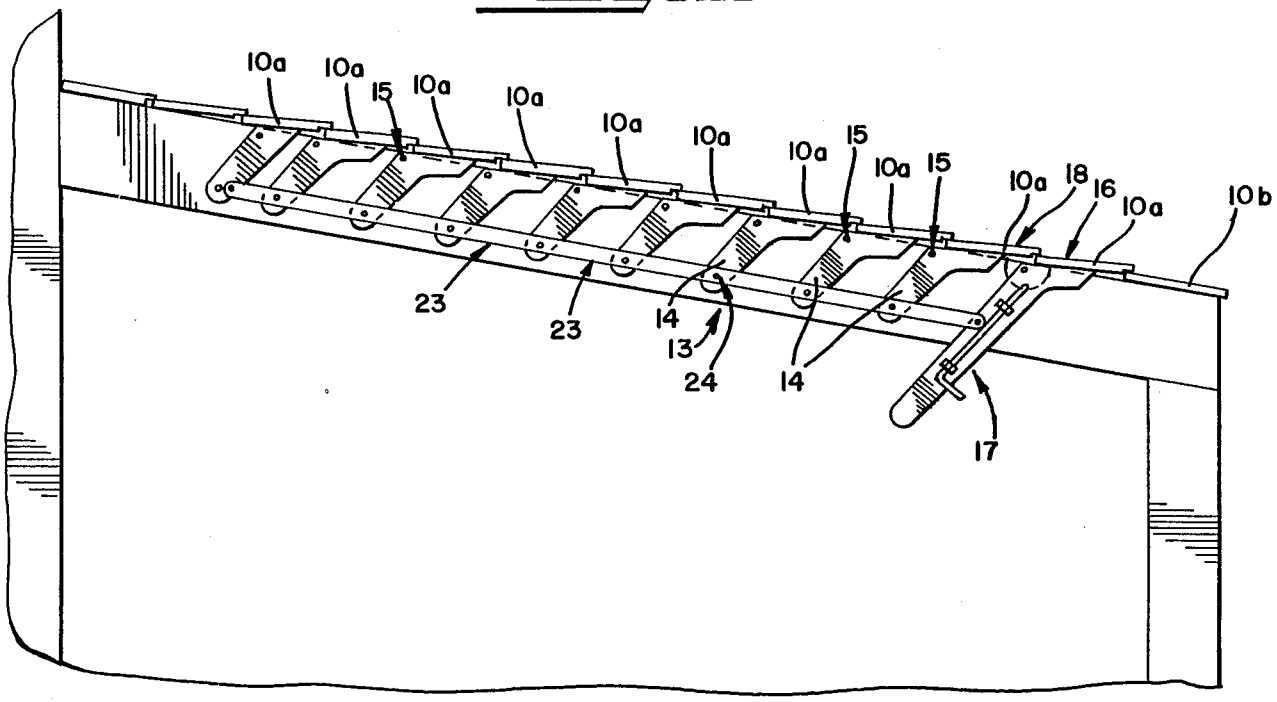
FIG. 2 is a vertical sectional view through the awning illustrated in FIG. 1.

With the louver vanes 10*a* in closed position, as seen in FIG. 2, it will be seen that the lower edge of each vane 10*a* overlaps the upper edge of the next lowermost vane 10*a*. This provides protection against rain or melting snow leaking through, of course.

The louver vanes 10*a* are also mounted on their respective pins 12 so that opening movement involves lifting of the entire vane upwardly. The upper edge of each vane 10*a* moves upwardly only a short distance, however, while the lower edge moves to a much greater extent. Positioning of the pivot pins 12 slightly upwardly of the upper edge of each corresponding vane, in the direction of the beams 5, produces this movement pattern.

Though the embodiment of the invention disclosed herein is preferred, numerous refinements, modifications and alterations will be apparent to those skilled in the art. Accordingly, all such refinements, modifications and alterations are intended to be covered by the appended claims.

I claim:

1. An adjustable, louvered awning inclined downwardly and extending outwardly from a building wall or the like and supported at its outer end, comprising:

(a) a plurality of beams extending substantially parallel to each other and forming an awning frame;

(b) a plurality of louver vanes extending across the top of each of said beams in parallel relationship to each other;

(c) each of said vanes having an upper edge and a lower surface, and a fitting protruding downwardly from said lower surface adjacent said upper edge in alignment with one side of at least one of said beams;

(d) each of said fittings being pivotally connected to said one side;

(e) said vanes being pivotally moveable between a position wherein they are lifted off said beams and the awning is opened and a position wherein the lower edges of each of said vanes overlap the upper edges of the next lower vane and the awning is closed;

(f) each of said vanes also having an operating arm protruding downwardly from said lower surface adjacent said upper edge in alignment with one side of one other one of said beams;

(g) each of said operating arms being pivotally connected to said one side of the corresponding one beam;

(h) an operating bar pivotally connected to the lower end of each of said operating arms; and (i) one of said operating arms including a blocking mechanism for releasably locking said vanes in any of a plurality of positions by engaging in, or disengaging from, a member on said corresponding one beam.

2. The adjustable, louvered awning of claim 1 further characterized in that:

(a) said blocking mechanism includes a rod mounted on said arm for movement longitudinally thereof into and out of engagement with said member.

3. The adjustable, louvered awning of claim 2 further characterized in that:

(a) said rod is normally spring biased into engagement with said member.

4. The adjustable, louvered awning of claim 3 further characterized in that:

(a) said member includes an indexing plate;

(b) said indexing plate having a plurality of indexing slots formed in it;

(c) said rod being selectively engageable with any one of said slots.

* * * * *